United States Patent [19]

Müller et al.

[11] 4,393,985

[45] Jul. 19, 1983

[54] LADLE SHROUD SUPPORT ASSEMBLY

[75] Inventors: Rudi Müller, Bad Oeynhausen; Wolfgang Löser, Wesel-Flüren, both of Fed. Rep. of Germany

[73] Assignee: Vesuvius International Corporation, Wilmington, Del.

[21] Appl. No.: 233,367

[22] Filed: Feb. 11, 1981

[30] Foreign Application Priority Data

Mar. 7, 1980 [GB] United Kingdom ..... 8007825

[51] Int. Cl.[3] ..... B22D 41/08

[52] U.S. Cl. ..... 222/591; 222/592; 222/607

[58] Field of Search ..... 222/590, 591, 600, 606, 222/607, 533, 536, 537, 601, 592

[56] References Cited

U.S. PATENT DOCUMENTS

| | | | |
|---|---|---|---|
| 2,143,758 | 1/1939 | Broms | 222/607 |
| 3,884,400 | 5/1975 | Tuschak et al. | 222/607 |
| 3,907,022 | 9/1975 | Simons et al. | 222/606 X |
| 4,079,869 | 3/1978 | Meier et al. | 222/600 |
| 4,091,861 | 5/1978 | Thalmann et al. | 222/607 X |
| 4,131,220 | 12/1978 | Bode, Jr. et al. | 222/607 |
| 4,222,505 | 9/1980 | Daussan et al. | 222/600 |
| 4,262,827 | 4/1981 | De Masi et al. | 222/607 |
| 4,275,825 | 6/1981 | King et al. | 222/600 X |
| 4,290,589 | 9/1981 | Luhrsen et al. | 222/606 X |
| 4,316,561 | 12/1982 | Grosko | 222/607 X |

FOREIGN PATENT DOCUMENTS

| | | |
|---|---|---|
| 33309 | 8/1981 | European Pat. Off. . |
| 2621557 | 4/1977 | Fed. Rep. of Germany . |
| 55-88975 | 7/1980 | Japan . |
| 1157818 | 7/1969 | United Kingdom . |
| 502705 | 4/1972 | U.S.S.R. . |
| 397262 | 2/1974 | U.S.S.R. . |

*Primary Examiner*—David A. Scherbel

*Attorney, Agent, or Firm*—Sughrue, Mion, Zinn, Macpeak and Seas

[57] ABSTRACT

A support assembly for a pouring stream protection shroud 1 at the outlet gate of a metal pour vessel comprises an intermediate bearing ring 3 provided between a flange 2 of the protection shroud and a shroud holding ring 4 supporting said shroud at the outlet gate of the metal pour vessel. The holding ring may be provided with cooling gas channels 12, 13, and the bearing ring and holding ring are interlocked by pins 8 extending into a peripheral groove 7 formed in the holding ring and sandwiching a further intermediate bearing ring 16 therebetween. Lubricant may be supplied to the sliding surfaces through peripheral bores 6 and connecting bores 17 formed in the intermediate bearing rings.

10 Claims, 5 Drawing Figures

LADLE SHROUD SUPPORT ASSEMBLY

SUBJECT MATTER OF THE INVENTION

This invention relates to apparatus for holding a protection shroud at the outlet gate of a metal pour vessel.

BACKGROUND OF THE INVENTION

During casting of metal from pouring vessels the pouring stream of molten metal may be shielded with a protection tube, called a ladle shroud. Such shrouds are commonly supported in front of the pouring gate by means of a holding device consisting of a supporting ring, supporting fork and supporting lever. When such holding devices are used in connection with a linear or rotary slide gate at the vessel outlet however, movement of the slide gate has resulted in imparting a rotary movement to the ladle shroud and consequently to the collector nozzle gate. Apart from being a source of wear for the refractory parts this also involves the risk of disengaging said parts from their supports.

It is the object of this invention to provide a new holding device for ladle shrouds which will avoid the above mentioned drawbacks of the known holding devices.

DETAILED DESCRIPTION OF THE INVENTION

Figure 1:
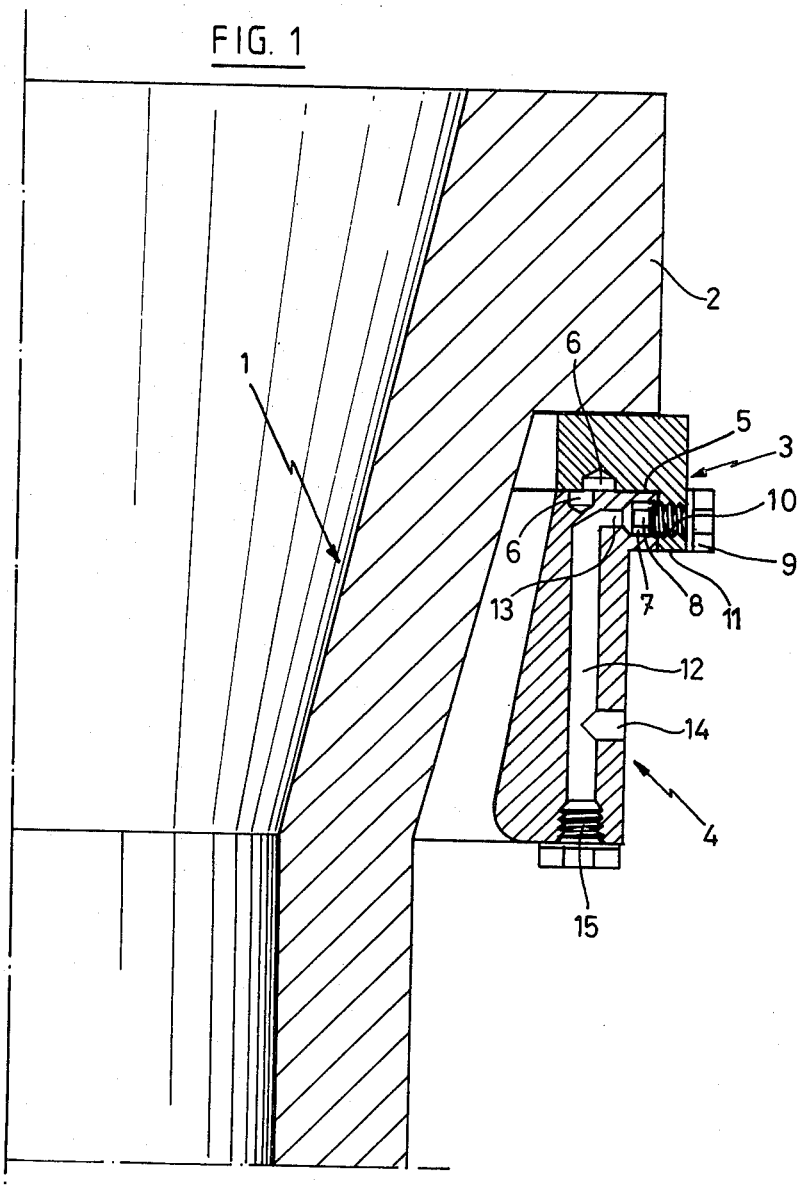

According to the invention there is provided a support assembly for a pouring stream protection shroud at the outlet gate of a metal pour vessel, in which at least one intermediate bearing ring is provided between the protection shroud and a shroud holding ring supporting said shroud at the outlet gate of the metal pour vessel.

In a preferred embodiment of the invention, said intermediate bearing ring(s) form with said shroud holding ring at least one plain sliding surface for an easy rotation motion of the protection shroud with respect to the holding ring, to avoid any rotation of the protection shroud with respect to the outlet gate.

Said intermediate bearing ring(s) and/or the shroud holding ring may suitably comprise means for supplying lubricant to said plain sliding surface(s), which may in particular consist of peripheral lubrication bores.

According to a further preferred feature of the invention, the shroud holding ring and the intermediate bearing ring(s) may constitute an interlocking unit, wherein the intermediate bearing ring(s) is/are slidably attached to the holding ring by suitable interlocking means.

Said interlocking means may in particular consist of rods, pins or the like, disposed on an outer peripheral flange of the intermediate ring, which rods, pins or the like extend into a peripheral groove formed on the outer surface of the holding ring.

The new provisions according to the invention ensure a free rotating motion of the holding device with respect to the protection shroud, even at high temperatures.

FIGURES

The fundamental features of the invention will now be described in greater detail having reference to the attached drawings, illustrating two preferred embodiments of the ladle shroud holding device in accordance with the invention.

Figure 2:
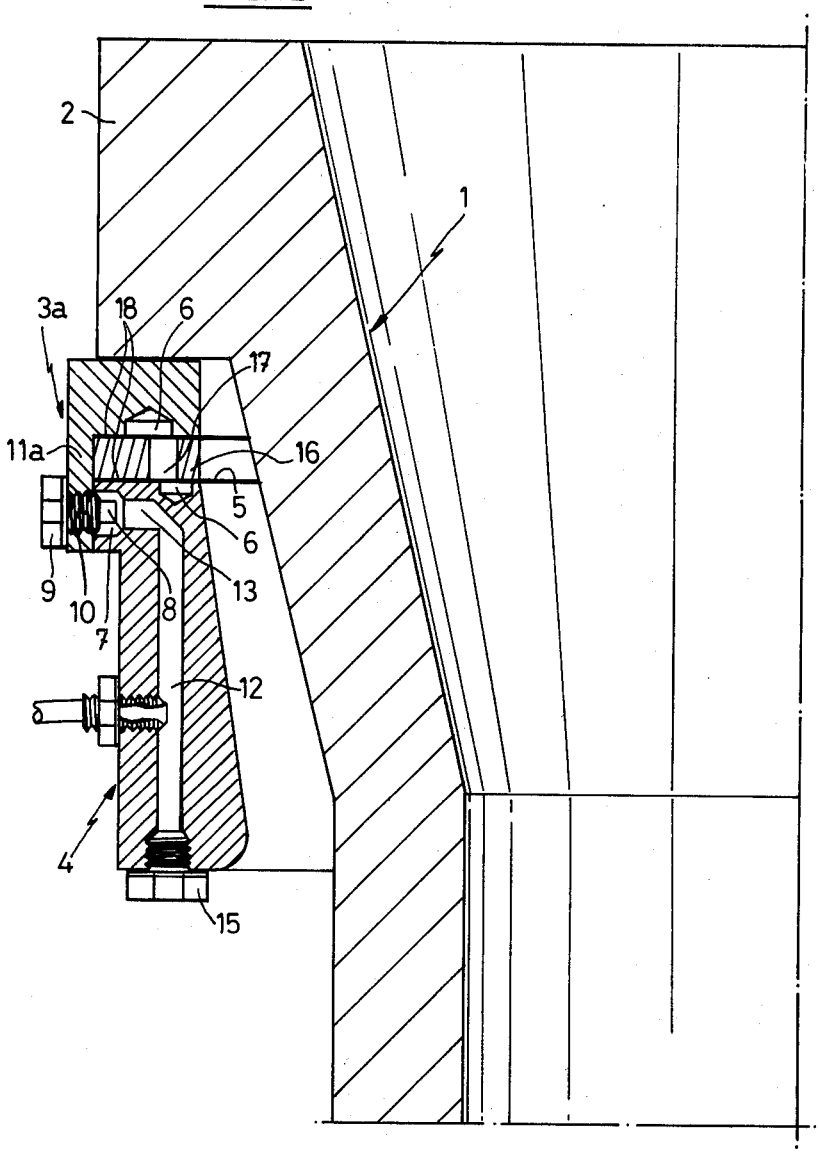
Figure 3:
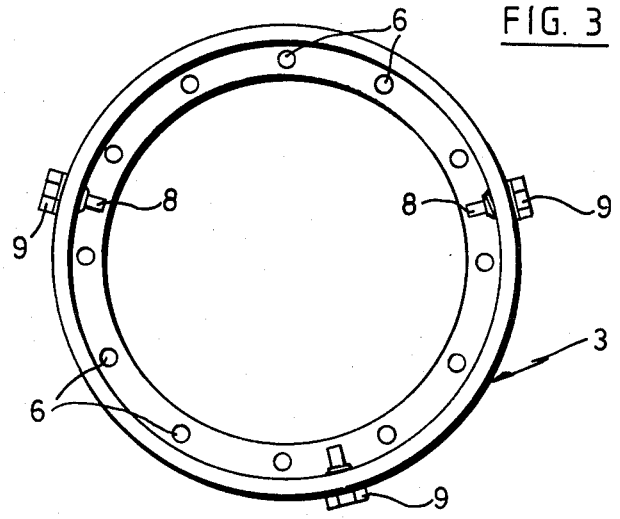
Figure 5:
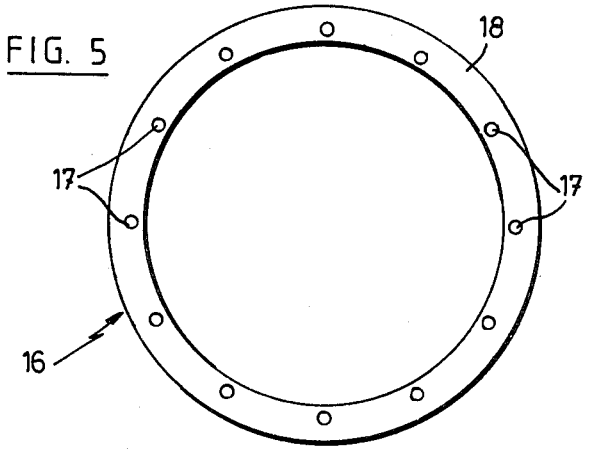
Figure 4:
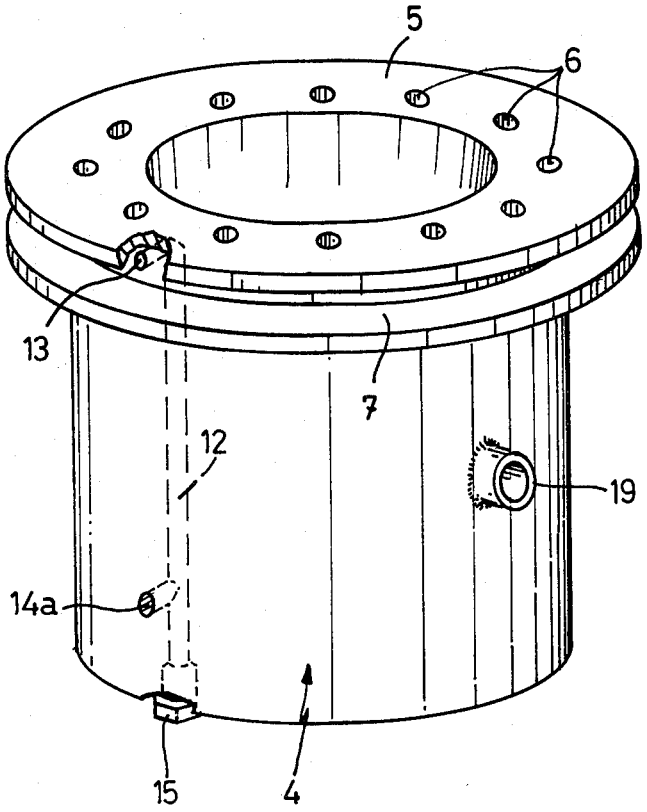

In the Drawings:

FIG. 1 is a sectional view of a first embodiment of a ladle shroud holding device according to the invention (right hand side shown), FIG. 2 is a sectional view of a second embodiment of a ladle shroud holding device according to the invention (left hand side shown), FIG. 3 is a bottom plan view of the top bearing ring in the devices of FIGS. 1 and 2, FIG. 4 is a perspective view of the bottom holding ring in the devices of FIGS. 1 and 2, FIG. 5 is a top plan view of the middle bearing ring in the device of FIG. 2.

In these figures, same reference numerals are used to indicate same parts.

FIG. 1 shows, in section, the right hand side of a pouring stream protection tube (ladle shroud) 1, bearing with its supporting flange 2 on a bearing ring 3, provided between said supporting flange 2 and a shroud holding ring 4, so as to form a planar surface 5 between said rings for an easy sliding rotation thereof with respect to each other.

In order to improve the sliding performance, the bearing ring 3 and the holding ring 4 are provided with lubrication bores 6 over the whole extent of their sliding surfaces.

The holding ring 4 comprises a peripheral groove 7, into which engage the extremities 8 of assembling bolts 9, which are fixed into bores 10 through an outer peripheral flange 11 of the bearing ring 3.

The holding ring 4 further also comprises two (one represented in the right hand side of the ring) cooling bores 12, communicating with said peripheral groove 7, through bores 13.

Cooling gas is introduced and evacuated from the holding ring 4 through respective bores 14, **14*a*, whereas the bottoms of the cooling bores are closed by means of bolts 15**.

As shown more particularly on FIG. 4, the holding ring 4 is provided with spindle supports 19 adapted to engage a supporting fork (not represented) for the holding ring.

FIG. 2 shows, in section, the left hand side of a pouring stream protection tube (ladle shroud) 1, supported on a second embodiment of the holding device according to the invention, similar to the embodiment of FIG. 1 except that a further, intermediate, bearing ring 16 is provided between the bearing ring **3*a* and the holding ring 4. The lateral circumferential flange 11*a* of said bearing ring 3*a* is therefore increased to the extent of the thickness of the intermediate ring 16, with respect to the flange 11 of the bearing ring 3 of the embodiment of FIG. 1**.

The intermediate ring 16 itself is provided with lubrication holes 17, extending between both sliding surfaces 18 and distributed over the whole periphery thereof (FIG. 5).

The remainder of the holding device according to FIG. 2 is identical to that of FIG. 1 and in particular the holding ring 4 is exactly as represented in FIGS. 1 and 4.

The bottom view of the bearing ring **3*a* on the other hand corresponds to the representation of FIG. 3, in that it only differs from the bearing ring 3 by the height of its peripheral flange 11*a***.

It must be clear that the invention is not limited to those embodiments and details specifically disclosed hereabove and that numerous modifications may be provided to said details without leaving the general outline of the invention as set forth in the attached set of claims.

What we claim is:

1. An assembly for supporting a pouring stream protection shroud at the outlet gate of a metal pour vessel, which assembly comprises: a shroud holding ring (4) supporting said shroud (1) at the outlet gate of the metal pour vessel and adapted to be connected to a shroud supporting fork, and an intermediate bearing ring (3) disposed between the protection shroud and the shroud holding ring, said intermediate bearing ring forming a planar sliding surface (5) with said shroud holding ring to enable free rotational motion of the protection shroud with respect to the holding ring and to thereby avoid any rotation of the protection shroud with respect to the outlet gate, the intermediate bearing ring and the shroud holding ring including means (6) for supplying lubricant to said planar sliding surface.

2. An assembly according to claim 1, in which said lubrication means consists of peripheral lubrication bores.

3. An assembly for supporting a pouring stream protection shroud at the outlet gate of a metal pour vessel, which assembly comprises: a shroud holding ring (4) supporting said shroud (1) at the outlet gate of the metal pour vessel and adapted to be connected to a shroud supporting fork, and an intermediate bearing ring (3) disposed between the protection shroud and the shroud holding ring, wherein the shroud holding ring and the intermediate bearing ring comprise an interlocking unit, the intermediate bearing ring being slidably attached to the holding ring by interlocking means, said interlocking means comprising an outer peripheral flange (11) on the intermediate bearing ring, a peripheral groove (7) formed in an outer surface of the holding ring, and a plurality of pin means (8) extending from the flange into the groove.

4. An assembly for supporting a ladle protection shroud cooperable with a movable plate of a rotary slide gate mechanism of a metal pour vessel for protecting the pouring of molten metal into a mould, comprising: a flange (2) extending outwardly from a ladle protection shroud (1), a shroud holding ring (4), an intermediate bearing ring (3) disposed between the flange and the holding ring and configured to define a planar annular sliding surface (5) with the holding ring to enable free rotational motion of the shroud and bearing ring about the holding ring and interlocking means for slidably coupling the bearing ring to the holding ring and for preventing relative axial motion between said rings.

5. An assembly according to claim 4, wherein the shroud holding ring comprises means (6) for supplying lubricant between the intermediate bearing ring and the shroud holding ring.

6. An assembly according to claim 5, wherein the lubrication means consists of peripheral lubrication bores.

7. An assembly according to claim 4, wherein the interlocking means comprises a peripheral groove (7) formed along the outer surface of the holding ring, and means on the bearing ring cooperable with said groove for allowing relative sliding movement between the holding ring and the bearing ring.

8. An assembly according to claim 7, wherein the cooperable means on the bearing ring comprises an external peripheral flange (11), and pins means (8) mounted on said flange and extending into said groove.

9. An assembly according to claim 4, further comprising an additional bearing ring (16) disposed between the intermediate bearing ring and the holding ring.

10. An assembly according to claim 9, wherein the additional bearing ring is provided with lubrication bores (17) extending therethrough.

* * * * *